US005411277A

United States Patent [19]

Pratt

[11] Patent Number: 5,411,277

[45] Date of Patent: May 2, 1995

[54] MULTI-TERRAIN IN-LINE SKATE CHASSIS

[75] Inventor: Michael K. Pratt, Ware, Mass.

[73] Assignee: Seneca Sports, Inc., Milford, Mass.

[21] Appl. No.: 102,476

[22] Filed: Aug. 3, 1993

[51] Int. Cl.[6] ..... A63C 17/06

[52] U.S. Cl. ..... 280/11.22; 280/11.27; 280/43

[58] Field of Search ..... 280/11.22, 11.23, 11.27, 280/43, 842, 11.19, 11.25, 11.26

[56] References Cited

U.S. PATENT DOCUMENTS

| | | | |
|---|---|---|---|
| 1,116,840 | 11/1914 | Porter | 280/11.22 |
| 1,771,855 | 7/1930 | MacMillan | 280/11.23 |
| 2,166,767 | 7/1939 | Petermann | 280/843 |
| 2,760,589 | 8/1956 | Rudman | 280/43 X |
| 2,879,074 | 3/1959 | Roberton et al. | 280/43 |
| 2,882,063 | 4/1959 | Strasel | 280/43 |
| 3,086,790 | 4/1963 | Thompson | 280/43 |
| 3,339,936 | 9/1967 | Hamlin | 280/11.23 |
| 3,415,533 | 12/1968 | Bliss, Jr. | 280/43 |
| 3,885,804 | 5/1975 | Cudmore | 280/11.2 |
| 4,323,259 | 4/1982 | Boudreau | 280/7.13 |
| 4,392,659 | 7/1983 | Yoshimoto | 280/11.23 |
| 4,603,868 | 8/1986 | Schutz | 280/7.13 |
| 4,768,793 | 9/1988 | Spencer | 280/842 |
| 4,805,936 | 2/1989 | Krantz | 280/11.2 X |
| 4,899,524 | 2/1990 | Eilles | 280/43 X |
| 4,928,982 | 5/1990 | Logan | 280/11.22 |
| 5,171,032 | 12/1992 | Dettmer | 280/11.2 |

FOREIGN PATENT DOCUMENTS

| | | | |
|---|---|---|---|
| 8701888 | 3/1989 | Netherlands | 280/11.22 |

OTHER PUBLICATIONS

International Search Report for PCT Application No. US94/07818 (mailed Sep. 30, 1994).

*Primary Examiner*—Margaret A. Focarino
*Assistant Examiner*—Michael Mar
*Attorney, Agent, or Firm*—Fish & Richardson

[57] ABSTRACT

A multi-terrain in-line skate chassis has at least one base plate for supporting a skate boot and a single, vertically oriented wheel support plate having an upper edge. The base plate has a side edge and defines a base plane, and the upper edge of the wheel support plate is joined to the base plate along the side edge. The wheel support plate defines at least a first set of apertures and a second set of apertures. The first set of apertures is located at a first set of predetermined distances below the base plane. The second set of apertures is located at a second set of predetermined distances below the base plane, the second set of predetermined distances being different from the first set of predetermined distances.

11 Claims, 4 Drawing Sheets

MULTI-TERRAIN IN-LINE SKATE CHASSIS

BACKGROUND OF THE INVENTION

This invention relates to skates having in-line or tandem rollers.

In-line roller skates known in the art generally have either three or four wheels aligned in a vertical plane coinciding with the center of gravity of the skate. These wheels are typically mounted on axles supported on both sides of the wheels by wheel support plates.

These known skates are suitable for skating on dry asphalt and other hard surfaces. The wheels of these skates, however, tend to slip when used on wet surfaces, and debris may become lodged between the wheels and mounting plates when used on debris laden surfaces.

SUMMARY OF THE INVENTION

According to one aspect of the invention, a multi-terrain in-line skate chassis comprises at least one base plate for supporting a skate boot, the base plate having a side edge and defining a base plane; a single vertically oriented wheel support plate having an upper edge, the upper edge of the wheel support plate joined to the base plate along the side edge; the wheel support plate defining at least a first set of apertures and a second set of apertures; the first set of apertures located at a first set of predetermined distances below the base plane, and the second set of apertures located at a second set of predetermined distances below the base plane, the second set of predetermined distances being different from the first set of predetermined distances.

Preferred embodiments of this aspect of the invention may include one or more of the following additional features. The base plate includes a heel plate positioned to support a heel portion of the skate boot and defining the base plane, and a toe plate positioned to support a toe portion of the skate boot. The first set of apertures of the wheel support plate are equally spaced along the wheel support plate at the first set of predetermined distances below the base plane. The second set of apertures of the wheel support plate are equally spaced along the wheel support plate at the second set of predetermined distances below the base plane. The first set and/or the second set of predetermined distances are uniform.

According to another aspect of the invention, a multi-terrain in-line skate chassis adapted for selectively mounting three wheels or four wheels in tandem has a center of gravity located in a vertical chassis plane, and comprises at least one base plate for supporting a skate boot, the base plate having a side edge parallel to the vertical chassis plane, and the base plate defining a base plane; a single vertical wheel support plate having an upper edge joined to the base plate along the side edge, and wheel support plate defining a first set of three apertures and a second set of four apertures; the first set of three apertures located at a first set of three predetermined distances below the base plane; the second set of four apertures located at a second set of four predetermined distances below the base plane, the second set of four predetermined distances being different from the first set of three predetermined distances; a plurality of axles selectively cantilevered horizontally inwardly, toward the center of gravity, selectively from the first set of three apertures or from the second set of four apertures, such that the axles intersect the vertical chassis plane; and a plurality of wheels rotatably mounted on the axles and positioned in a manner such that the respective central wheel planes of each of the wheels and the vertical chassis plane coincide.

Preferred embodiments of this aspect of the invention may include one or more of the following additional features. The base plate includes a heel plate positioned to support a heel portion of the skate boot and defining the base plane, and a toe plate formed to support a toe portion of the skate boot. The first set of three apertures and/or the second set of four apertures are equally spaced along the wheel support plate at the respective set of predetermined distances below the base plate. The first set and/or the second set of predetermined distances are uniform. The skate chassis further comprises a bushing mounted on each axle between the wheel support plate and the wheel mounted on the axle thereby to maintain the coincidental position of the central wheel plane with the vertical chassis plane. The skate chassis further comprises a locking element mounted on each axle for retaining the wheel mounted thereupon. Each wheel has a rough texture surface.

Accordingly, it is an objective of this invention to provide a chassis for in-line skates which is able to selectively and interchangeably accommodate wheels of different widths and diameters, thereby providing a skate capable of maintaining traction on wet surfaces and reducing the possibility of having debris lodged between the wheel and wheel support plate.

Other features and advantages of the invention will be apparent from the following detailed description of the invention, when read in connection with the accompanying drawings, and the claims.

DESCRIPTION OF THE PREFERRED EMBODIMENTS

Figure 1:
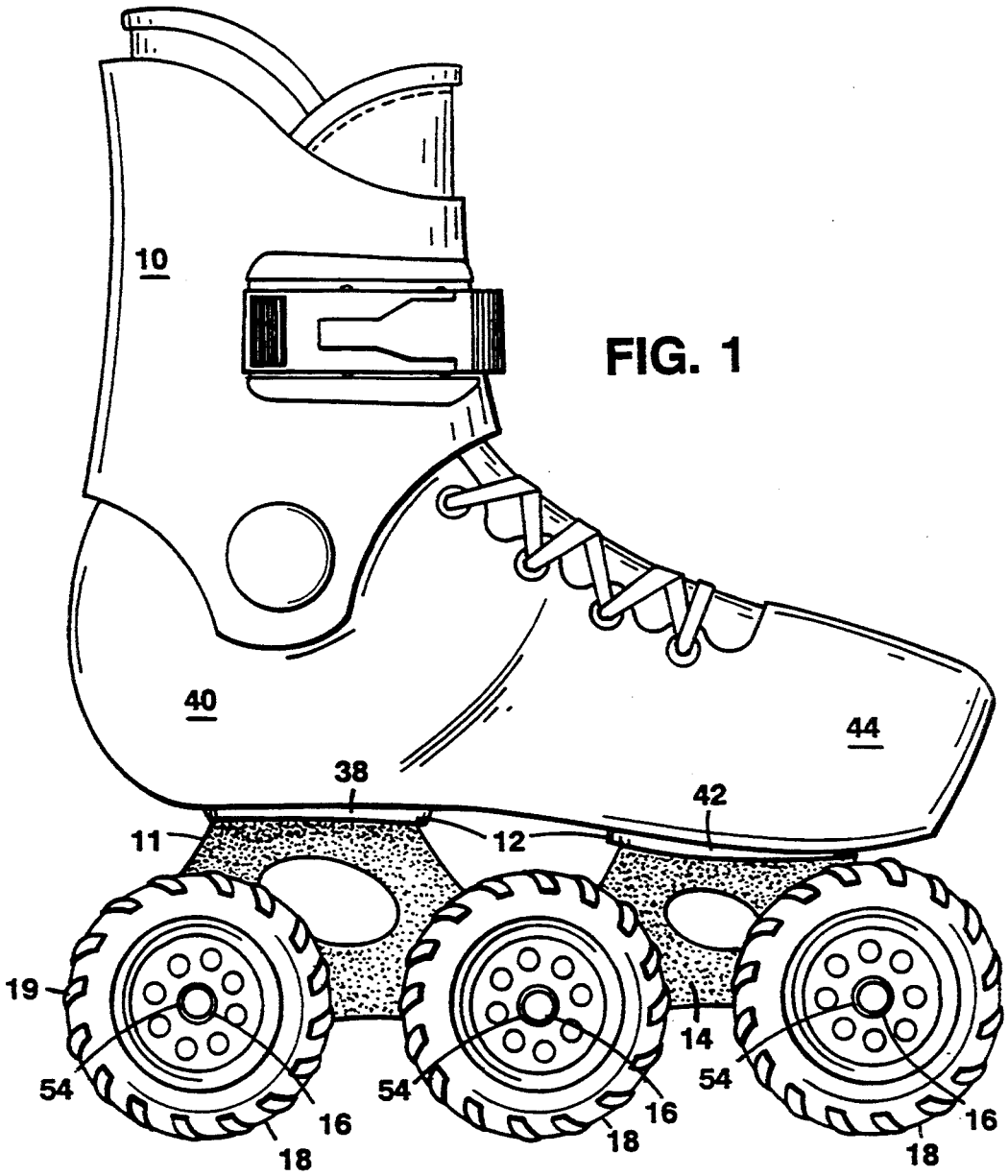
FIG. 1 is a side view of an in-line skate having a skate chassis of the invention.
Figure 2:
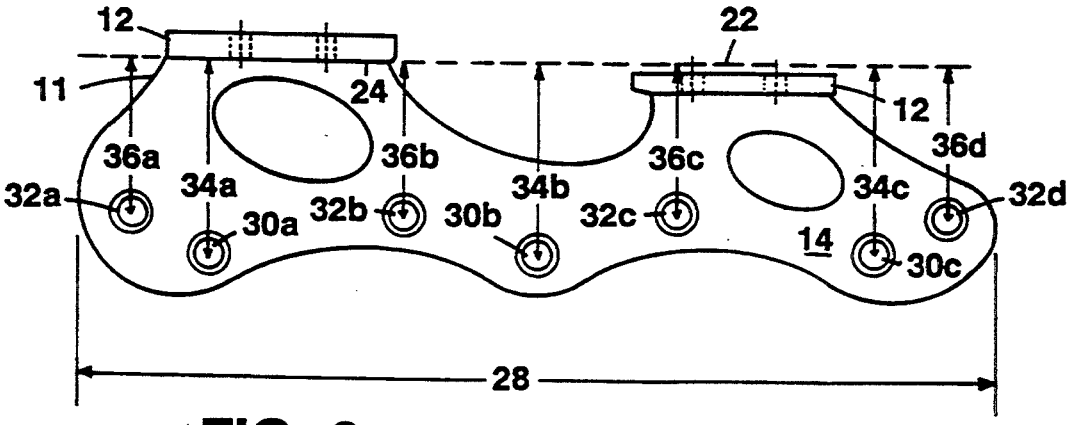
FIG. 2 is a side view of the skate chassis of FIG. 1.
Figure 3:
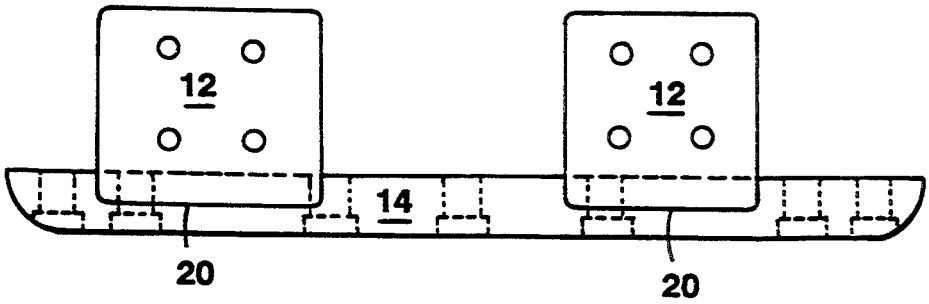
FIG. 3 is a top view of the skate chassis of FIG. 1.
Figure 4:
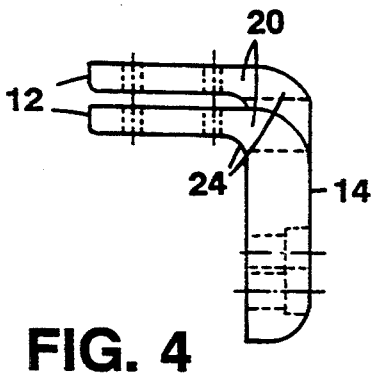
FIG. 4 is a front view of the skate chassis of FIG. 1.
Figure 5:
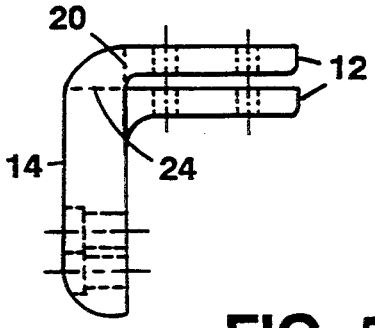
FIG. 5 is a rear view of the skate chassis of FIG. 1.
Figure 6:
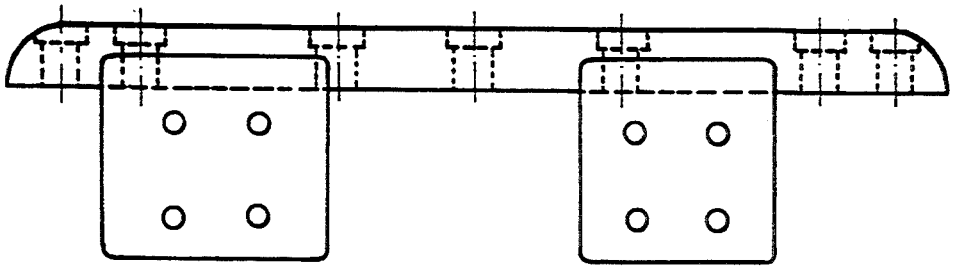
FIG. 6 is a bottom view of the skate chassis of FIG. 1.

Referring now to FIG. 1, an in-line or tandem skate 8 includes a skate boot 10 mounted on a skate chassis 11 of the invention. The chassis includes one or more generally horizontal base plates, e.g. a heel base plate 12 and a separate toe base plate 12', and a generally vertical wheel support plate 14. The set of wheels 18, e.g. three are shown, are rotatably mounted upon cantilevered axles 16 extending from the wheel support plate 14. In the embodiment shown, the wheels 18 have a rough, textured surface 19. Referring now generally to FIGS. 2 through 6, the heel base plate 12 has a side edge 20 and defines base plane 22. The toe base plate 12' has a side edge 20' and lies generally below base plane 22. Wheel support plate 14 has upper edges 24, 24' and it is joined along these upper edges to the respective side edges 20, 20' of heel and toe base plates 12, 12'.

The wheel support plate 14 defines a first set 30 of apertures 30*a*, 30*b*, 30*c* and a second set 32 of apertures 32*a*, 32*b*, 32*c*, 32*d*. The first set of apertures 30*a*, 30*b*, 30*c* are located a first set of respective predetermined distances 34*a*, 34*b*, 34*c* below base plane 22. The second set of apertures 32*a*, 32*b*, 32*c*, 32*d* are similarly located a second set of respective predetermined distances 36*a*, 36*b*, 36*c*, 36*d* below base plane 22.

Heel base plate 12 is positioned to support a surface 38 of the heel region 40 of skate boot 10. The toe base plate 12' is similarly positioned to support a surface 42 of the toe region 44 of skate boot 10.

In the preferred embodiment shown, apertures 30*a*, 30*b* and 30*c* are equally spaced apart along the length 28 of the skate chassis, and the predetermined distances 34*a*, 34*b* and 34*c* are equal, i.e. the apertures 30*a*, 30*b*, 30*c* lie in a common plane parallel to horizontal plane 22. Similarly, in the preferred embodiment, apertures 32*a*, 32*b*, 32*c* and 32*d* are equally spaced apart along the length 28 of the skate chassis, and the predetermined distances 36*a*, 36*b*, 36*c* and 36*d* are equal, with the apertures 32*a*, 32*b*, 32*c* and 32*d* lying in a common plane parallel to horizontal plane 22 and also to the plane of apertures 30*a*, 30*b*, 30*c*.

Figure 7:
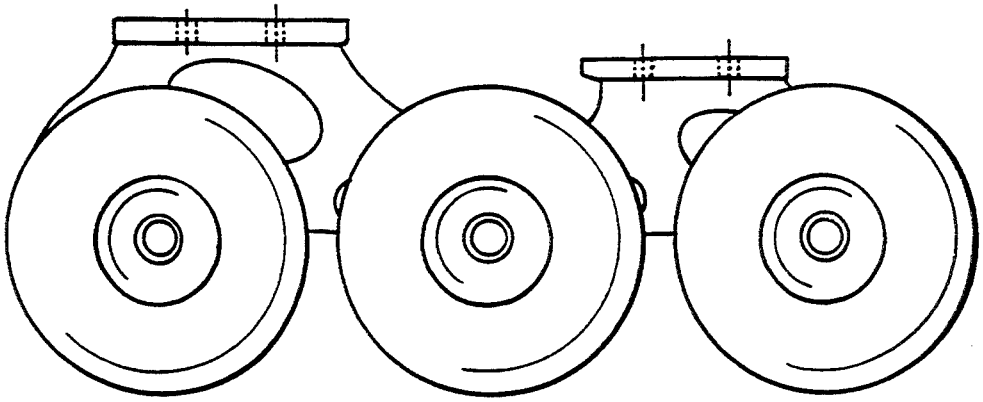
FIG. 7 is a side view of a skate chassis of the invention with three wheels mounted thereupon.
Figure 8:
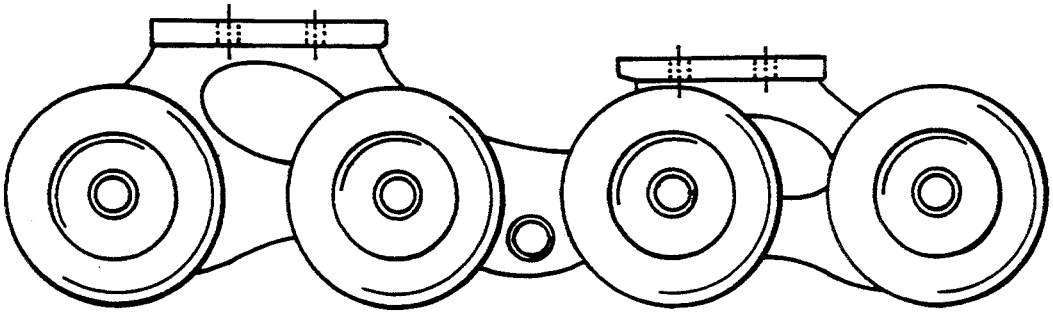
FIG. 8 is a side view of a skate chassis of the invention with four wheels mounted thereupon.
Figure 9:
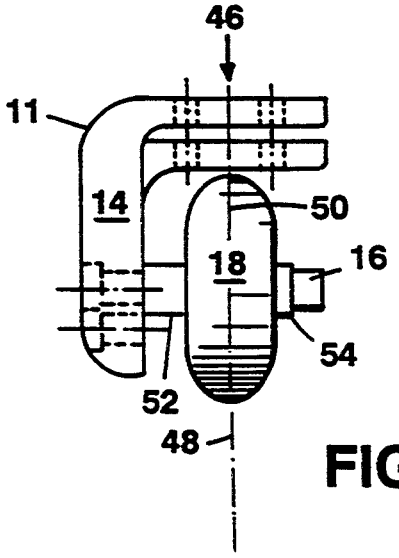
FIG. 9 is a front view of a skate chassis of the invention with wheels attached.

Referring now to FIGS. 7 through 9, skate chassis 11 has center of gravity 46 located in vertical chassis plane 48. Side edge 20 of heel base plate 12, and side edge 20' of toe base plate 20' are parallel to vertical chassis plane 48. Axles 16 are lodged in first set 30 of apertures 30*a*, 30*b*, 30*c* (FIG. 7) or axles 16 are lodged in second set 32 of apertures 32*a*, 32*b*, 32*c*, 32*d* (FIG. 8), with the axles extending from the wheel support plate 14 in a manner to intersect vertical chassis plane 48. A plurality of wheels 18, each having central wheel plane 50, are rotatably mounted on the axles 16, positioned by bushings 52 mounted on axles 16 and secured by locking elements 54, so that the central wheel plane 50 of each wheel coincides with the vertical chassis plane 48 and the center of gravity.

Other embodiments are within the following claims. For example, the apertures 30*a*, 30b and 30*c*, and/or the apertures 32*a*, 32*b*, 32*c* and 32*d*, may have non-uniform spacing. Also, the predetermined distances 34*a*, 34*b* and 34*c*, and/or the predetermined distances 36*a*, 36*b*, 36*c* and 36*d*, may not be uniform, i.e. one or more of apertures 30*a*, 30*b* and 30*c*, and/or apertures 32*a*, 32*b*, 32*c* and 32*d*, may lie in a horizontal plane different from that of other apertures in the set.

What is claimed is:

1. A multi-terrain in-line skate chassis comprising:

at least one base plate for supporting a skate boot, said base plate having a side edge and defining a base plane;

a single vertically oriented wheel support plate having an upper edge, said upper edge of said wheel support plate joined to said base plate along said side edge;

said wheel support plate defining at least a first set of longitudinally aligned, axle receiving apertures and a second set of longitudinally aligned, axle receiving apertures;

said first set of apertures being located at a first predetermined distance below said base plane, and said second set of apertures being located at a second predetermined distances below said base plane, said second predetermined distance being different from said first predetermined distance, and each aperture of said second set of apertures being longitudinally offset from each aperture of said first set of apertures.

2. The multi-terrain in-line skate chassis of claim 1 wherein said base plate includes a heel plate positioned to support a heel portion of said skate boot and defining said base plane, and a toe plate positioned to support a toe portion of said skate boot.

3. The multi-terrain in-line skate chassis of claim 1 wherein said first set of apertures of said wheel support plate are equally spaced along said wheel support plate at said first predetermined distance below said base plane.

4. The multi-terrain in-line skate chassis of claim 1 wherein said second set of apertures of said wheel support plate are equally spaced along said wheel support plate at said second predetermined distance below said base plane.

5. A multi-terrain in-line skate chassis adapted for selectively mounting three wheels or four wheels in tandem, said skate chassis having a center of gravity located in a vertical chassis plane; and said chassis comprising:

at least one base plate for supporting a skate boot, said base plate having a side edge parallel to said vertical chassis plane, and said base plate defining a base plane;

a single vertical wheel support plate having an upper edge joined to said base plate along said side edge, and wheel support plate defining a first set of three apertures and a second set of four apertures;

said first set of three longitudinally aligned, axle receiving apertures being located at a first predetermined distances below said base plane;

said second set of four longitudinally aligned, axle receiving apertures being located at a second predetermined distance below said base plane, said second predetermined distance being different from said first predetermined distance, and each aperture of said second set of apertures being longitudinally offset from each aperture of said first set of apertures;

a plurality of axles selectively cantilevered horizontally inwardly, toward said center of gravity, selectively from one of said first set of three apertures and said second set of four apertures, such that said axles intersect said vertical chassis plane; and a plurality of wheels rotatably mounted on said axles and positioned in a manner such that a central wheel plane of each of the wheels and said vertical chassis plane coincide.

6. The multi-terrain in-line skate chassis of claim 5 wherein said base plate includes a heel plate positioned to support a heel portion of said skate boot and defining said base plane, and a toe plate formed to support a toe portion of said skate boot.

7. The multi-terrain in-line skate chassis of claim 5 wherein said first set of three apertures are equally spaced along said wheel support plate at said first predetermined distance below said base plate.

8. The multi-terrain in-line skate chassis of claim 5 wherein said second set of four apertures are equally spaced along said wheel support plate at said second predetermined distance below said base plate.

9. The multi-terrain in-line skate chassis of claim 5 further comprising a bushing mounted on each said axle between said wheel support plate and the wheel mounted on said axle thereby to maintain the coincidental position of said central wheel plane with said vertical chassis plane.

10. The multi-terrain in-line skate chassis of claim 5 further comprising a locking element mounted on each said axle for retaining the wheel mounted thereupon.

11. The multi-terrain in-line skate chassis of claim 5 wherein each said wheel has a rough texture surface.

* * * * *